US007334354B2

(12) United States Patent
Foxen et al.

(10) Patent No.: US 7,334,354 B2
(45) Date of Patent: Feb. 26, 2008

(54) ADJUSTABLE ANKLE SUPPORT FOR AN ARTICLE OF FOOTWEAR

(75) Inventors: Thomas Foxen, Portland, OR (US); Joshua P. Heard, Clackamas, OR (US)

(73) Assignee: NIKE, Inc., Beaverton, OR (US)

( * ) Notice: Subject to any disclaimer, the term of this patent is extended or adjusted under 35 U.S.C. 154(b) by 281 days.

(21) Appl. No.: 10/860,383

(22) Filed: Jun. 4, 2004

(65) Prior Publication Data

US 2005/0268493 A1 Dec. 8, 2005

(51) Int. Cl.
*A43B 23/28* (2006.01)
*A43B 3/12* (2006.01)
*A43B 7/20* (2006.01)

(52) U.S. Cl. ..... 36/89; 36/58.6; 36/136; 36/100

(58) Field of Classification Search ..... 36/100, 36/101, 58.6, 89, 54; D2/896, 902, 907
See application file for complete search history.

(56) References Cited

U.S. PATENT DOCUMENTS

| | | | | |
|---|---|---|---|---|
| 916,061 | A | 3/1909 | Thorsch | |
| D85,954 | S | 1/1932 | Noble | |
| 1,844,997 | A * | 2/1932 | Weigle | 36/1.5 |
| 2,069,381 | A * | 2/1937 | Morgan | 36/54 |
| 2,346,415 | A * | 4/1944 | Clein et al. | 36/1.5 |
| 2,847,991 | A | 6/1958 | Andrews | |
| 3,327,410 | A | 6/1967 | Park, Sr. et al. | |
| 4,282,657 | A | 8/1981 | Antonious | |
| 4,411,077 | A | 10/1983 | Slavitt | |
| 4,489,719 | A | 12/1984 | Lapenskie | |
| 4,523,394 | A | 6/1985 | Lindh et al. | |
| 4,577,419 | A | 3/1986 | Chassaing | |
| 4,621,648 | A | 11/1986 | Ivany | |
| 4,676,011 | A | 6/1987 | O≦Rourke et al. | |
| 4,693,018 | A | 9/1987 | Maleyko et al. | |
| 4,922,630 | A | 5/1990 | Robinson | |
| 4,928,405 | A * | 5/1990 | Spademan | 36/50.1 |

(Continued)

FOREIGN PATENT DOCUMENTS

| | | |
|---|---|---|
| GB | 640332 | 7/1950 |

(Continued)

OTHER PUBLICATIONS

International Search Report in corresponding PCT Application, International Application No. PCT/US2005/019896, mailed Nov. 3, 2005.

*Primary Examiner*—Jila M Mohandesi
(74) *Attorney, Agent, or Firm*—Banner & Witcoff, Ltd.

(57) ABSTRACT

An article of footwear is disclosed that includes an upper, an ankle support, and a sole structure. The upper receives a foot of an individual and includes a tab that is convertible from a folded first position to an extended second position. The ankle support is configured to extend around an ankle of the individual, and the ankle support is positioned proximal the tab. The sole structure is secured to the upper. The footwear is convertible between a first configuration and a second configuration. The tab is in the folded first position and separate from the ankle support in the first configuration, and the tab is in the extended second position and joined with the ankle support in the second configuration.

22 Claims, 10 Drawing Sheets

U.S. PATENT DOCUMENTS 4,958,447 A 9/1990 Dupree et al.
5,109,614 A 5/1992 Curry et al.
5,848,484 A 12/1998 Dupree et al.
D493,027 S * 7/2004 Heil ..... D2/896
7,013,586 B1 * 3/2006 Hatfield et al. ..... 36/58.6

FOREIGN PATENT DOCUMENTS

WO WO 94/04049 3/1994

* cited by examiner

ADJUSTABLE ANKLE SUPPORT FOR AN ARTICLE OF FOOTWEAR

BACKGROUND OF THE INVENTION

1. Field of the Invention

The present invention relates to footwear with an ankle support. The invention concerns, more particularly, an ankle support for an article of footwear that is adjustable by an individual to provide varying degrees of stability to the article of footwear.

2. Description of Background Art

Conventional articles of athletic footwear generally include two primary elements, an upper and a sole structure. The upper is secured to the sole structure and forms a void on the interior of the footwear for comfortably and securely receiving a foot. The sole structure is positioned between the foot and the ground to attenuate ground reaction forces and absorb energy as the footwear contacts the ground. Accordingly, the upper and sole structure operate in concert to position the foot relative to the ground and to protect the foot.

The upper generally extends over the instep and toe areas of the foot, along the medial and lateral sides of the foot, and around the heel area of the foot. In some articles of footwear, such as basketball footwear and hiking boots, the upper may extend upward and around the ankle to provide support for the ankle. Access to the void on the interior of the footwear is generally provided by an ankle opening. A lacing system is often incorporated into the upper to selectively increase the size of the ankle opening and permit the wearer to modify certain dimensions of the upper, particularly girth, to accommodate feet with varying dimensions. In addition, the upper may include a tongue that extends under the lacing system to enhance the comfort of the footwear, and the upper may incorporate a heel counter to limit movement of the heel.

Various materials are conventionally utilized in manufacturing the upper. The upper of athletic footwear, for example, may be formed from multiple material layers that include an first layer, a middle layer, and an interior layer. The materials forming the first layer of the upper may be selected based upon the properties of wear-resistance, flexibility, and air-permeability, for example. With regard to the first layer, the toe area and the heel area may be formed of leather, synthetic leather, or a rubber material to impart a relatively high degree of wear-resistance. Leather, synthetic leather, and rubber materials may not exhibit the desired degree of flexibility and air-permeability. Accordingly, various other areas of the first layer of the upper may be formed from a synthetic textile. The first layer of the upper may be formed, therefore, from numerous material elements that each impart different properties to the upper. A middle layer of the upper may be formed from a lightweight polymer foam material that provides cushioning and protects the foot from objects that may contact the upper. Similarly, an interior layer of the upper may be formed of a moisture-wicking textile that removes perspiration from the area immediately surrounding the foot. In some articles of athletic footwear, the various layers may be joined with an adhesive, and stitching may be utilized to join elements within a single layer or to reinforce specific areas of the upper.

As discussed above, the upper of some articles of footwear may extend upward and around the ankle to provide support for the ankle. As an alternative, or in combination, the footwear may also incorporate an ankle support. U.S. Pat. No. 4,411,077 to Slavitt discloses an article of footwear having a generally conventional configuration. The footwear includes a pair of elastic and flexible straps that wrap around opposite sides of the ankle to limit the degree of inversion and eversion of the ankle. Another ankle support is disclosed in U.S. Pat. No. 4,922,630 to Robinson, in which an ankle strap extends from the lateral side of the footwear and around the ankle. This configuration purportedly resists inversion, while permitting a range of other foot motions. Similar ankle supports are disclosed in U.S. Pat. No. 4,621,648 to Ivany and U.S. Pat. No. 4,577,419 to Chassaing.

SUMMARY OF THE INVENTION

The present invention is an article of footwear that includes an upper, an ankle support, and a sole structure. The upper receives a foot of an individual and includes a tab that is convertible from a first position to a second position. The ankle support is configured to extend around an ankle of the individual, and the ankle support is positioned proximal the tab. The sole structure is secured to the upper. The footwear is convertible between a first configuration and a second configuration. The tab is in the first position and separate from the ankle support in the first configuration, and the tab is in the second position and joined with the ankle support in the second configuration. Modifying the footwear between the first configuration and the second configuration may be utilized, for example, to change the degree of stability imparted by the ankle support.

The ankle support includes at least one ankle strap with a first part and a second part of a fastening system. The first part of the fastening system is joined with the second part of the fastening system when the ankle support extends around the ankle. The tab includes a third part of the fastening system, and the third part of the fastening system is joined with the first part of the fastening system when the footwear is in the second configuration. That is, the tab may join with the first part of the fastening system when the footwear is in the second configuration. The fastening system may be, for example, a hook and loop fastener.

In some embodiments of the invention, the ankle support may include a connecting member that is secured to a rear area of the footwear. In addition, the ankle support may include a pair of ankle straps that extend in opposite directions from an upper portion of the connecting member. The ankle straps may extend around opposite sides of the ankle and overlap when joined together, with the tab extending between the pair of ankle straps when the footwear is in the second configuration.

The tab may be secured to a tongue portion of the upper or any other portion of the upper, such as a medial area or a lateral area. The tab is folded downward in the first position, and the tab is extended upward in the second position. Similarly, the ankle support may be secured to a rear area of the upper or any other area of the upper. In some embodiments, the ankle support is removable from the footwear to place the footwear in a third configuration with a lesser degree of stability than either the first configuration and the second configuration.

Another aspect of the invention involves a method of modifying an article of footwear. The method includes placing the footwear in a first configuration by wrapping a first strap and a second strap of an ankle support around opposite sides of the ankle, overlapping the first strap and the second strap, and joining the first strap to the second strap. The method also includes placing the footwear in a second configuration by positioning a tab between the first strap and the second strap, the tab being secured to an upper of the footwear, and joining a fastener on the tab with a corresponding fastener on one of the first strap and the second strap.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1A:
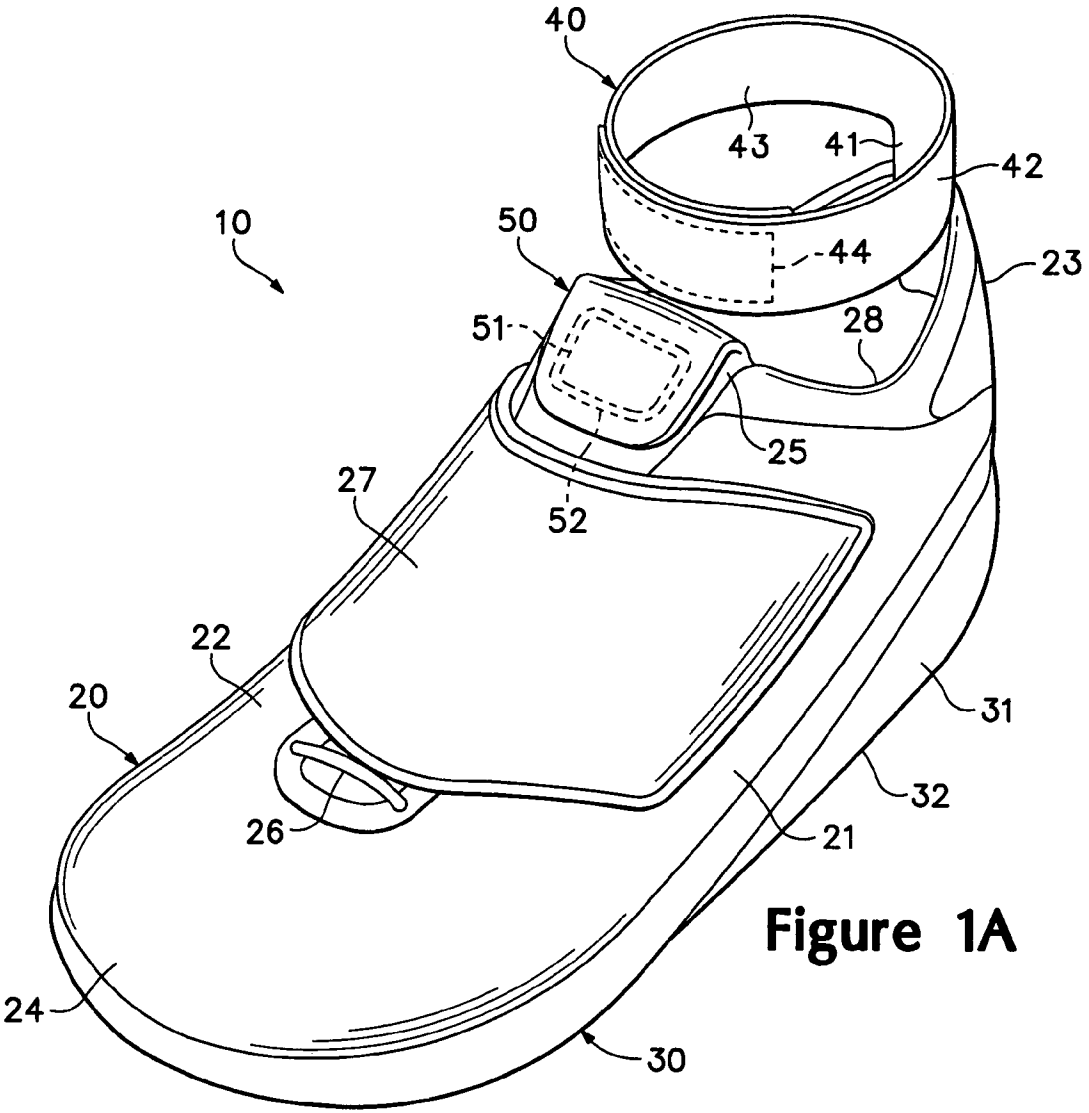
FIG. 1A is perspective view of a first article of footwear in accordance with the present invention, the first article of footwear being in a first configuration.

The following discussion and accompanying figures disclose an article of athletic footwear with an adjustable ankle support. Concepts related to the ankle support are disclosed with reference to footwear having a configuration that is suitable for the sport of basketball. The invention is not solely limited to footwear designed for basketball, however, and may be applied to a wide range of athletic footwear styles that include running shoes, walking shoes, cross-training shoes, tennis shoes, soccer shoes, and football shoes, for example. In addition to athletic footwear, concepts related to the ankle support may be applied to non-athletic footwear (e.g., dress shoes or work boots) or footwear serving a medical or rehabilitative purpose. Accordingly, one skilled in the relevant art will appreciate that the concepts disclosed herein apply to a wide variety of footwear styles, in addition to the specific style discussed in the following material and depicted in the accompanying figures.

An article of footwear 10 in accordance with the present invention is depicted in FIGS. 1-5 and includes an upper 20, a sole structure 30, and an ankle support 40. In general, upper 20 is formed from a plurality elements that are stitched or adhesively bonded together to define a hollow structure for comfortably-receiving the foot. Sole structure 30 is secured to a lower surface of upper 20 to support the foot and form a ground-engaging element of article of footwear 10. Ankle support 40 extends upward from upper 20 and has a configuration that wraps around an ankle of the individual to impart stability, for example. As utilized herein, the term ankle is intended to refer generally to a lower portion of the leg.

Upper 20 is formed from various materials that combine to provide a generally hollow structure having a lateral side 21, an opposite medial side 22, a heel portion 23, a toe portion 24, and a tongue 25. In addition, upper 20 incorporates a lace 26 and a lace cover 27. Lace 26 extends over tongue 25 and through various apertures formed in lateral side 21 and medial side 22. Lace cover 27 extends over lace 26 to protect the laces during athletic activities, thereby preventing lace 26 from being unintentionally untied, for example. The interior surfaces of lateral side 21, medial side 22, heel portion 23, toe portion 24, and tongue 25 define a void for receiving the foot, and an ankle opening 28 provides access to the void. Upper 20 also incorporates a tab 50, which will be described in greater detail below.

Lateral side 21 of upper 20 is generally configured to contact and cover a lateral surface of the foot, and a portion of lateral side 21 extends over an instep of the foot to overlap a side of tongue 25. Medial side 22 of upper 20 has a similar configuration that generally corresponds with a medial surface of the foot. Accordingly, a portion of medial side 22 also extends over the instep of the foot to overlap an opposite side of tongue 25. Heel portion 23 is configured to extend around a heel area of the foot and may be formed of unitary (i.e., one piece) construction with lateral side 21 and medial side 22. Similarly, toe portion 24 of upper 20 is configured to extend over a fore portion of the foot, including the toes.

Tongue 25 extends over the instep and is positioned under lace 26 and under portions of lateral side 21 and medial side 22. One skilled in the relevant art will recognize that this generally conventional structure serves the dual purpose of accommodating feet with various proportions and securing the foot within the void. More particularly, the individual may selectively alter the relative position of lateral side 21 and medial side 22 by modifying the tension in lace 26, thereby causing upper 20 to expand and contract around the foot. By increasing the tension in lace 26, the volume of the void effectively decreases and lateral side 21 and medial side 22 are drawn against the surfaces of the foot. In this manner, upper 20 is tightened around the foot in order to securely and comfortably position the foot within upper 20. By decreasing the tension in lace 26, however, the volume of the void within upper 20 increases and the foot may be withdrawn from upper 20, for example.

Sole structure 30 has a generally conventional configuration that includes a midsole 31 and an outsole 32. Midsole 31 is secured to a lower portion of upper 20 and is formed of a polymer foam material, such as ethylvinylacetate or polyurethane. Accordingly, midsole 31 attenuates ground reaction forces and absorbs energy (i.e., provides cushioning) as sole structure 30 impacts the ground. To enhance the force attenuation and energy absorption characteristics of sole structure 30, midsole 31 may incorporate a fluid-filled bladder, as disclosed in U.S. Pat. Nos. 4,183,156 and 4,219,945 to Rudy, for example. Alternately or in combination, midsole 31 may incorporate a plurality of discrete, columnar support elements, as disclosed in U.S. Pat. Nos. 5,343,639 and 5,353,523 to Kilgore et al., and manufactured by Nike, Incorporated of Beaverton, Oreg. under the SHOX trademark Outsole 32 is secured to a lower surface of midsole 31 and may be formed from carbon black rubber compound to provide a durable, wear-resistant surface for engaging the ground. Outsole 32 may also incorporate a textured lower surface to enhance the traction characteristics of article of footwear 10. In addition, article of footwear 10 may include an insole (not depicted), which is a relatively thin, cushioning member located within upper 20 and adjacent to a plantar surface of the foot for enhancing the comfort of article of footwear 10.

Sole structure 30 is described above as having the elements of a conventional sole structure for athletic footwear. Other footwear styles, including, dress shoes and boots, for example, may have other types of conventional sole structures specifically tailored for use with the respective types of footwear. In addition to a conventional configuration, however, sole structure 30 may also exhibit a unique, non-conventional structure. Accordingly, the particular configuration of sole structure 30 may vary significantly within the scope of the present invention to include a wide range of configurations, whether conventional or non-conventional.

Figure 4:
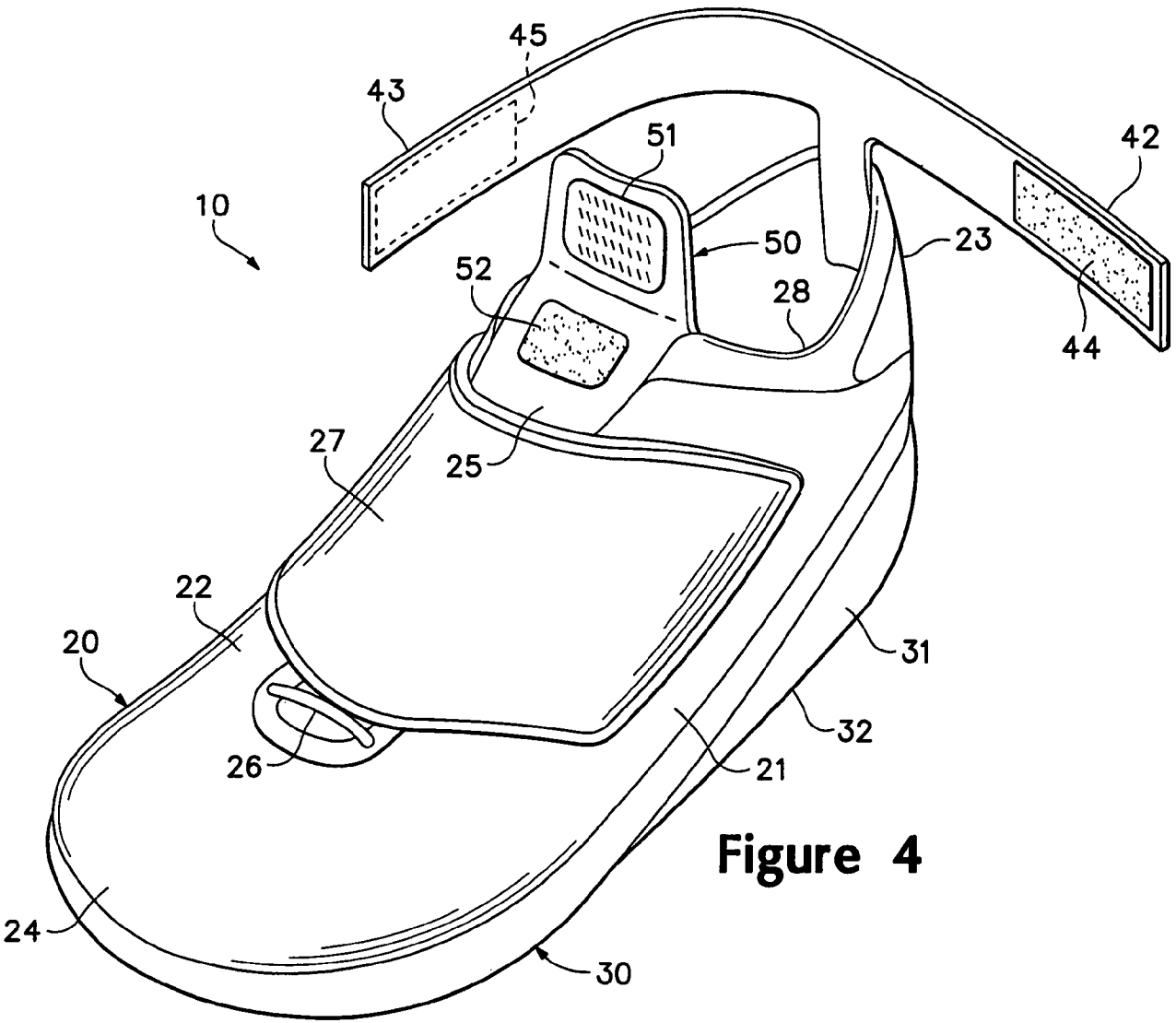
FIG. 4 is a perspective view of the first article of footwear in an intermediate state between the first configuration and the second configuration.

Ankle support 40 is secured to upper 20 and extends above ankle opening 28. The primary elements of ankle support 40 are a connector strap 41, a lateral strap 42 and a medial strap 43. As depicted in FIG. 4, for example, ankle support 40 has a generally T-shaped or Y-shaped configuration, wherein connector strap 41 forms the vertical segment and straps 42 and 43 form the horizontal or inclined segments. Connector strap 41 secures ankle support 40 to upper 20 and extends downward along the interior surface of heel portion 23. Connector strap 41 may be removable or otherwise secured to the interior surface of heel portion 23 in a non-permanent manner. Alternately, an adhesive or stitching process may be utilized to permanently secure connector strap 41 to upper 20, or connector strap 41 may extend between the various material elements forming heel portion 23.

Lateral strap 42 extends from an end of connector strap 41 and a first part 44 of a two-part fastener is secured to a surface of lateral strap 42. Similarly, medial strap 43 extends from the same end of connector strap 41 and a second part 45 of the two-part fastener is secured to an opposite surface of medial strap 43. Accordingly, lateral strap 42 and medial strap 43 join with connector strap 41 in a position that corresponds with the back of the heel. In operation, lateral strap 42 extends around a lateral side of the ankle and medial strap 43 extends around a medial side of the ankle. When medial strap 43 overlaps lateral strap 42, first part 44 contacts second part 45 and ankle support 40 is secured around the ankle. A downward force upon article of footwear 10, particularly heel portion 23 will place tension upon connector strap 41. Due to the connection between ankle support 40 and both of upper 20 and the ankle, however, movement of heel portion 23 relative to the foot will be limited.

The materials forming connector strap 41 and straps 42 and 43 may vary significantly within the scope of the present invention. For example, these elements may be formed of natural or synthetic leather, a durable textile, or polymer sheet, such as vinyl, for example. The surface of ankle support 40 positioned to contact the ankle may also incorporate a moisture-wicking textile that removes perspiration from the area between ankle support 40 and the ankle, thereby limiting the quantity of moisture adjacent the ankle. First part 44 and second part 45 of the two-part fastener are depicted as a hook-and-loop fastener, such as VELCRO, which is manufactured by Velcro Industries B.V. An advantage of the hook-and-loop fastener structure is that the diameter of the loop formed by straps 42 and 43 when encircling the ankle may be easily adjusted by the individual to a desired size. In addition to hook-and-loop fasteners, however, a snap-type fastener, a magnetic fastener, or any other practical type of fastener may be utilized on straps 42 and 43.

Figure 1B:
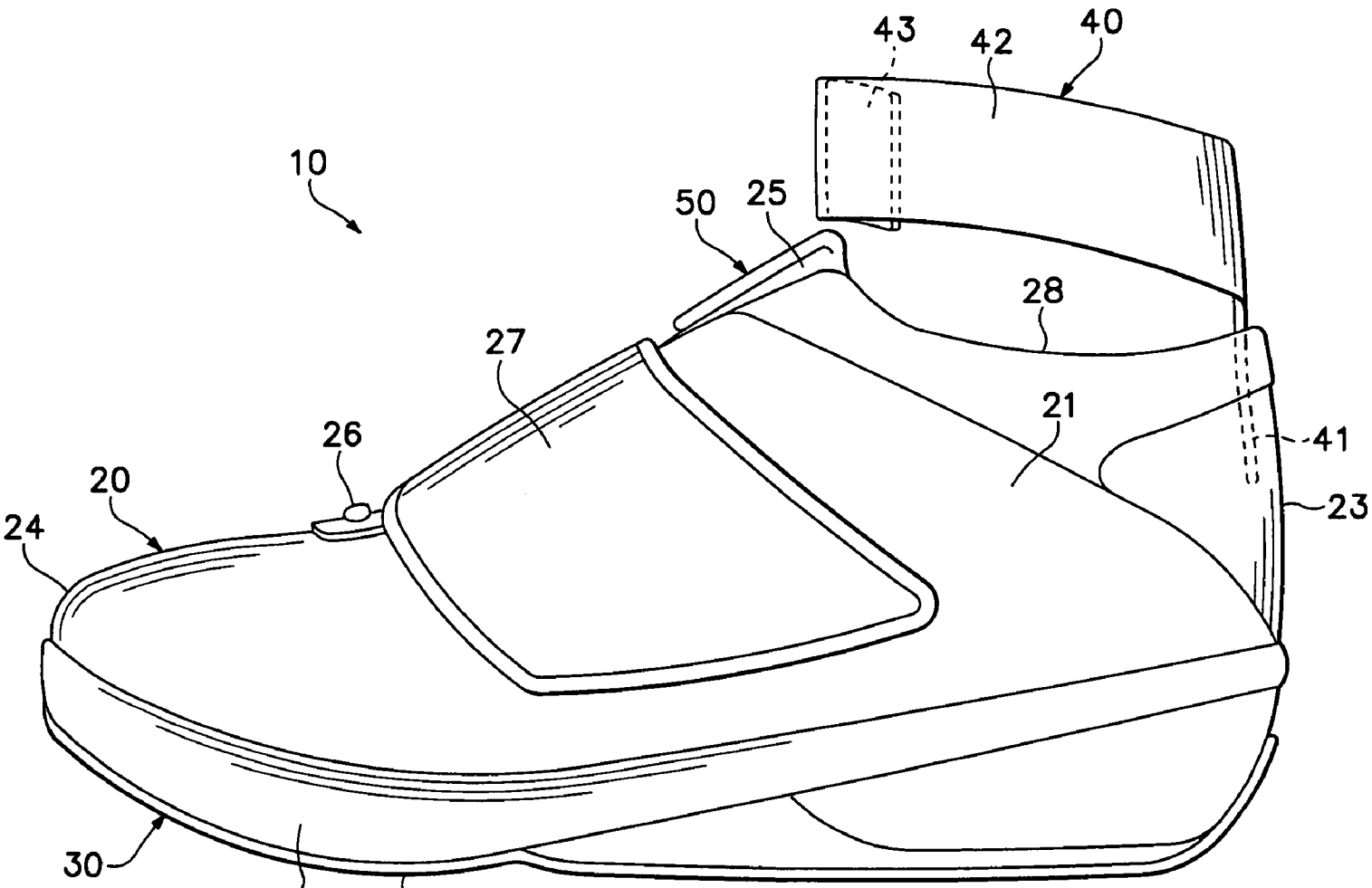
FIG. 1B is a side elevational view of the first article of footwear in the first configuration.
Figure 2A:
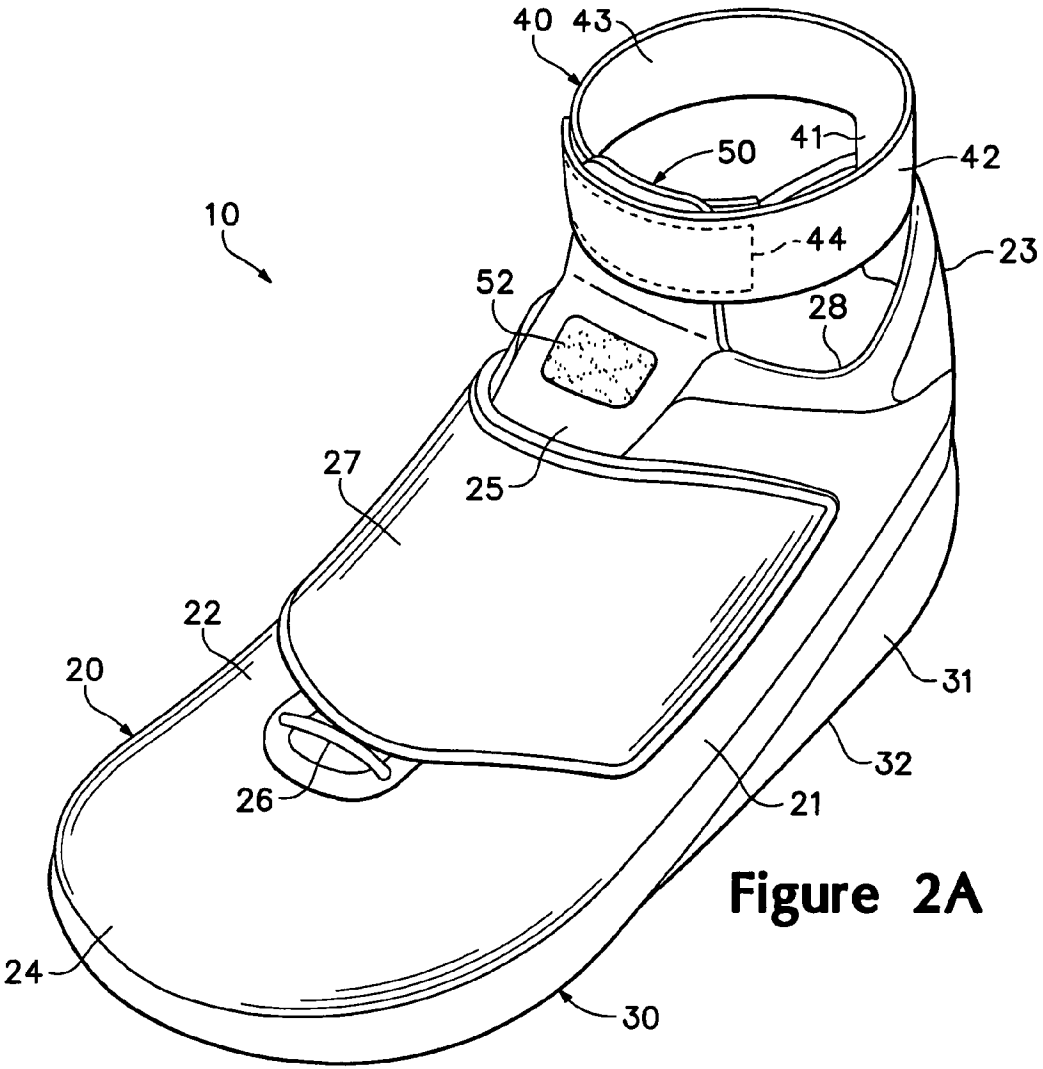
FIG. 2A is a perspective view of the first article of footwear in a second configuration.
Figure 2B:
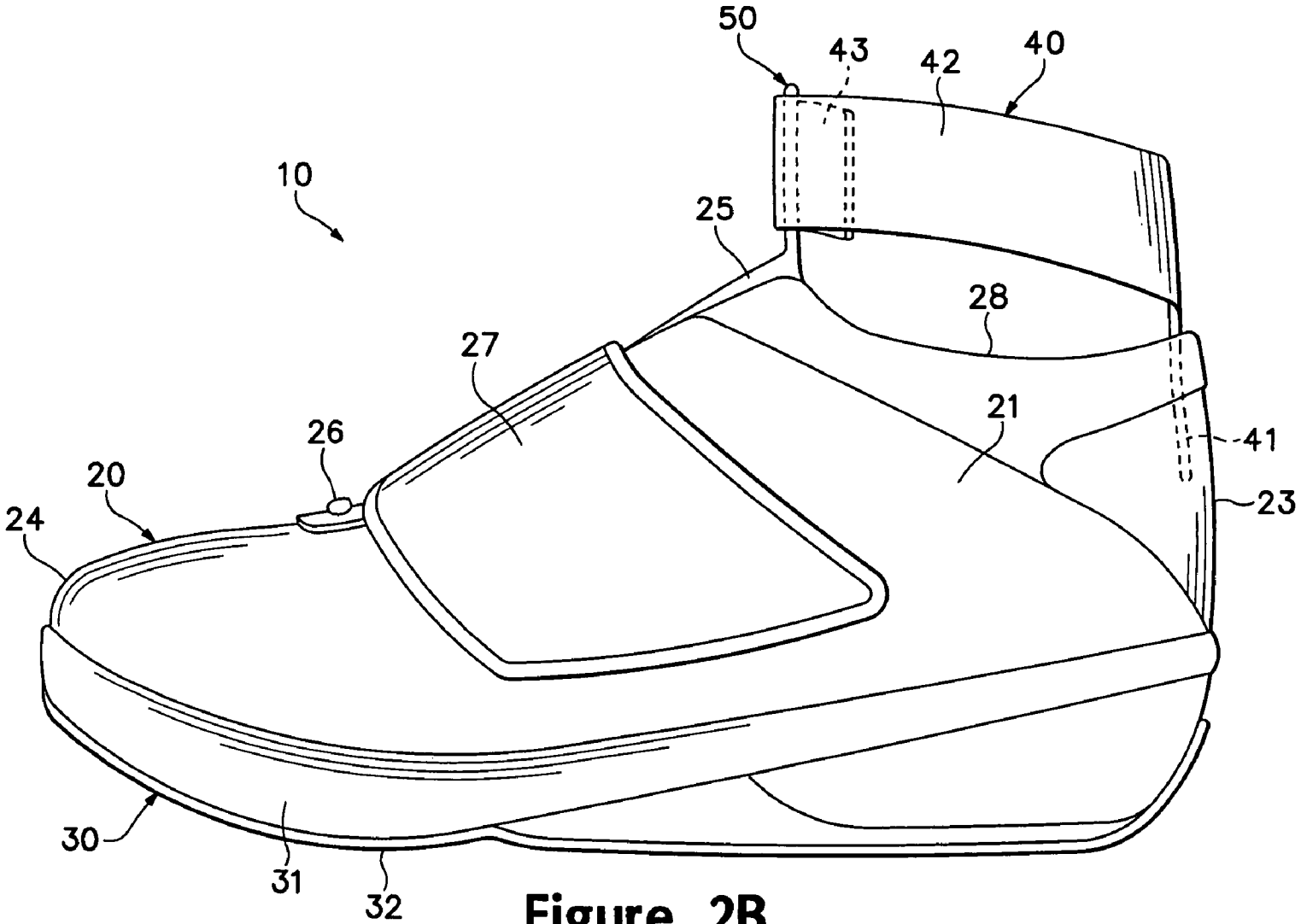
FIG. 2B is a side elevational view of the first article of footwear in the second configuration.

Tab 50 is secured to tongue 25 and exhibits a flexible configuration. More particularly, tab 50 may be placed in a folded first position, as depicted in FIGS. 1A and 1B, or tab 50 may be placed in an extended second position, as depicted in FIGS. 2A and 2B. In order to secure tab 50 in the folded first position, corresponding parts 51 and 52 of a two-part fastener, such as the hook-and-loop fastener, may be respectively secured to tab 50 and tongue 25. In order to secure tab 50 in the extended second portion, parts 51 and 52 of the two-part fastener are separated and tab 50 is positioned between straps 42 and 43. Part 51 of the two-part fastener may be substantially similar to second part 45, which is secured to medial strap 43. Part 51 may, therefore, removably-join with first part 44 to further secure tab 50 in the extended second position and in a location between straps 42 and 43.

Ankle support 40 is adjustable by the individual to provide varying degrees of stability to article of footwear 10. Referring to FIGS. 1A and 1B, ankle support 40 is in a position that extends around the ankle, and tab 50 is in the folded first position and unsecured or otherwise unconnected to ankle support 40. In this first configuration, article of footwear 10 is structured to provide a first degree of stability. More particularly, ankle support 40 extends around the ankle and limits the relative movement of the ankle and the foot. For example, ankle support 40 may limit the degree of inversion and eversion in the foot, or ankle support 40 may limit rotational motion in the foot. Accordingly, ankle support 40 may be utilized to impart a first degree of stability to article of footwear 10 when configured in the manner depicted in FIGS. 1A and 1B.

With reference to FIGS. 2A and 2B, ankle support 40 is in a position that extends around the ankle, and tab 50 is in the extended second position and positioned between straps 42 and 43. In this second configuration, article of footwear 10 is structured to provide a second degree of stability. More particularly, ankle support 40 extends around the ankle and limits the relative movement of the ankle and the foot, and tab 50 is joined with ankle support 40 to further limit the relative movement of the ankle and the foot. That is, joining tab 50 with ankle support 40 operates to provide greater stability to article of footwear 10. Accordingly, ankle support 40 may be utilized in combination with tab 50 to impart a greater second degree of stability to article of footwear 10.

Preferences of the individual may determine whether article of footwear 10 is utilized in the first configuration (i.e., as depicted in FIGS. 1A and 1B) or the second configuration (i.e., as depicted in FIGS. 2A and 2B). During practice sessions, for example, the individual may opt to place article of footwear 10 in the second configuration to impart greater stability. During competitions, however, the individual may opt for lesser stability and place article of footwear 10 in the first configuration. Some individuals may also prefer that article of footwear 10 remain in either the first configuration or the second configuration for both practice sessions and competitions. Accordingly, the configuration of article of footwear 10 may be modified based upon the degree of stability preferred by the individual and the various activities the individual engages in while wearing article of footwear 10.

Figure 3A:
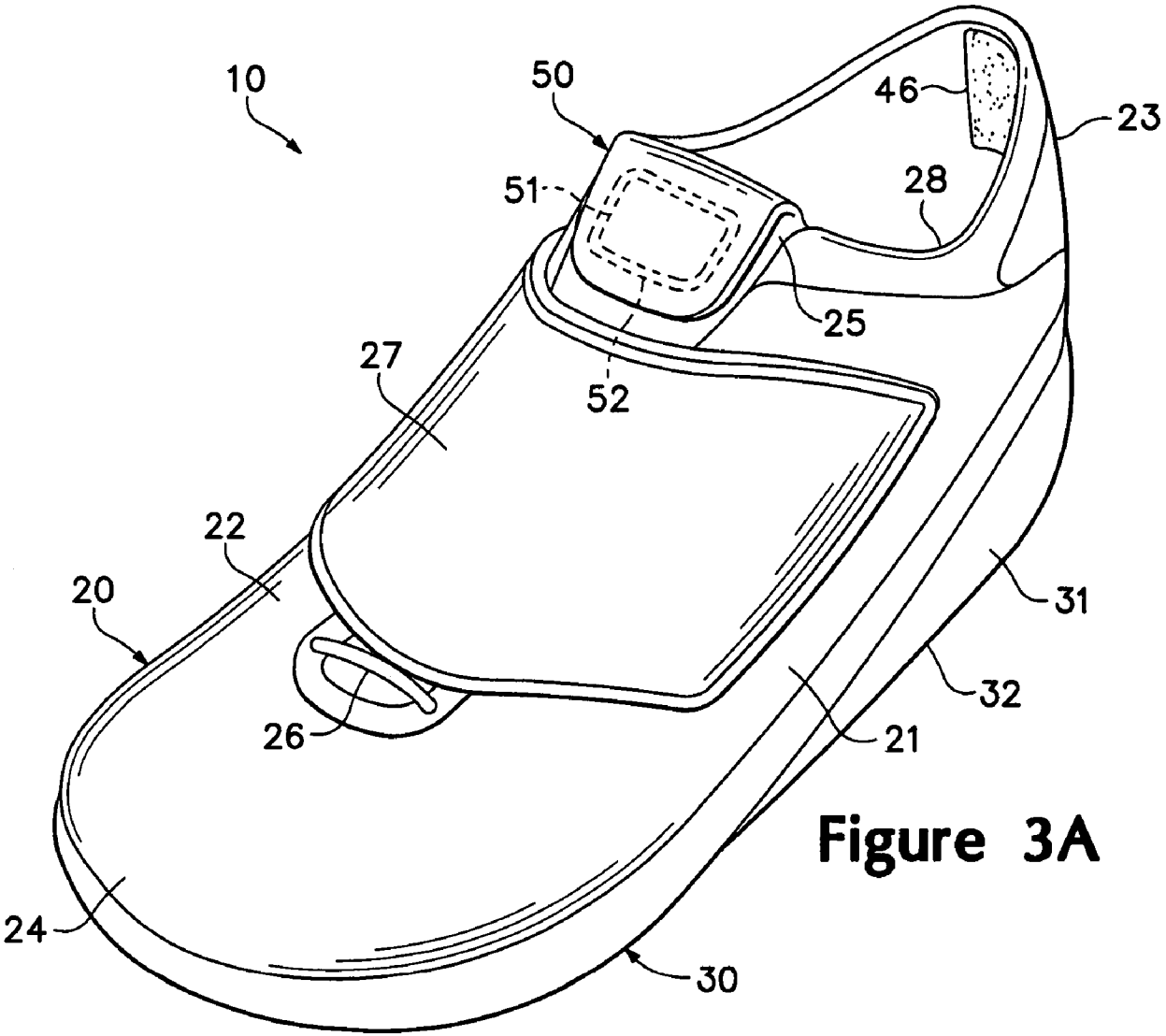
FIG. 3A is a perspective view of the first article of footwear in a third configuration.
Figure 3B:
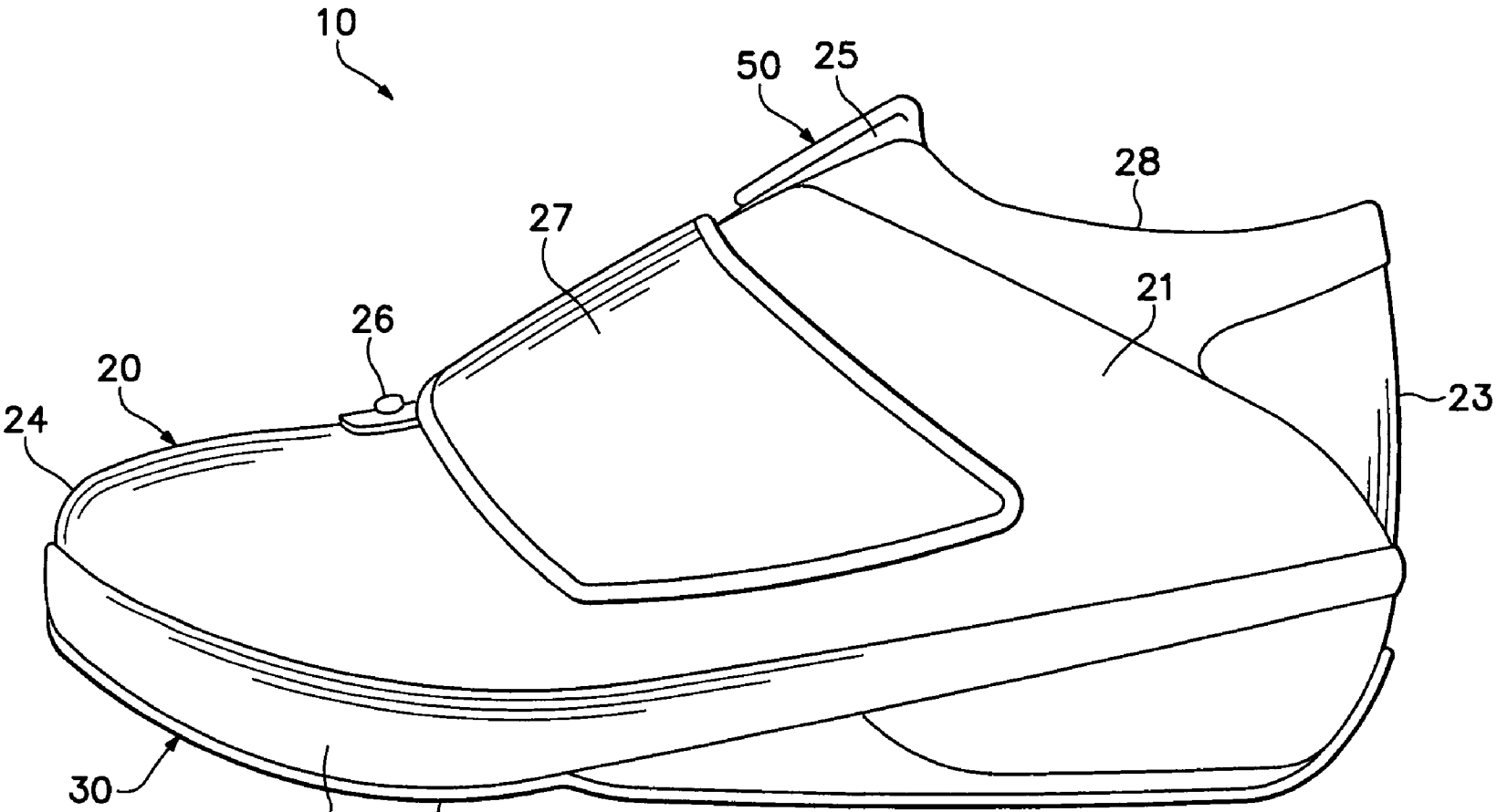
FIG. 3B is a side elevational view of the first article of footwear in the third configuration.

Referring to FIGS. 3A and 3B, article of footwear 10 is depicted in a third configuration, wherein ankle support 40 is removed from article of footwear 10 and tab 50 is in the folded first position. As discussed above, connector strap 41 may be removable or otherwise secured to the interior surface of heel portion 23 in a non-permanent manner. A fastener 46 may be secured to the interior surface of heel portion 23 (as depicted in FIG. 3A) in order to join ankle support 40 to upper 20. Fastener 46 is a portion of a two-part fastener system that joins with a corresponding part (not depicted) on connector strap 41. When ankle support 40 is removed, article of footwear 10 is in a third configuration that provides a lesser degree of stability than either the first or the second configuration. When utilizing article of footwear 10 for non-athletic activities, for example, the individual may prefer the lesser degree of stability that is imparted through removal of ankle support 40. The individual may also prefer the lesser degree of stability during either practice sessions or competitions, depending upon the particular preferences of the individual.

Figure 5:
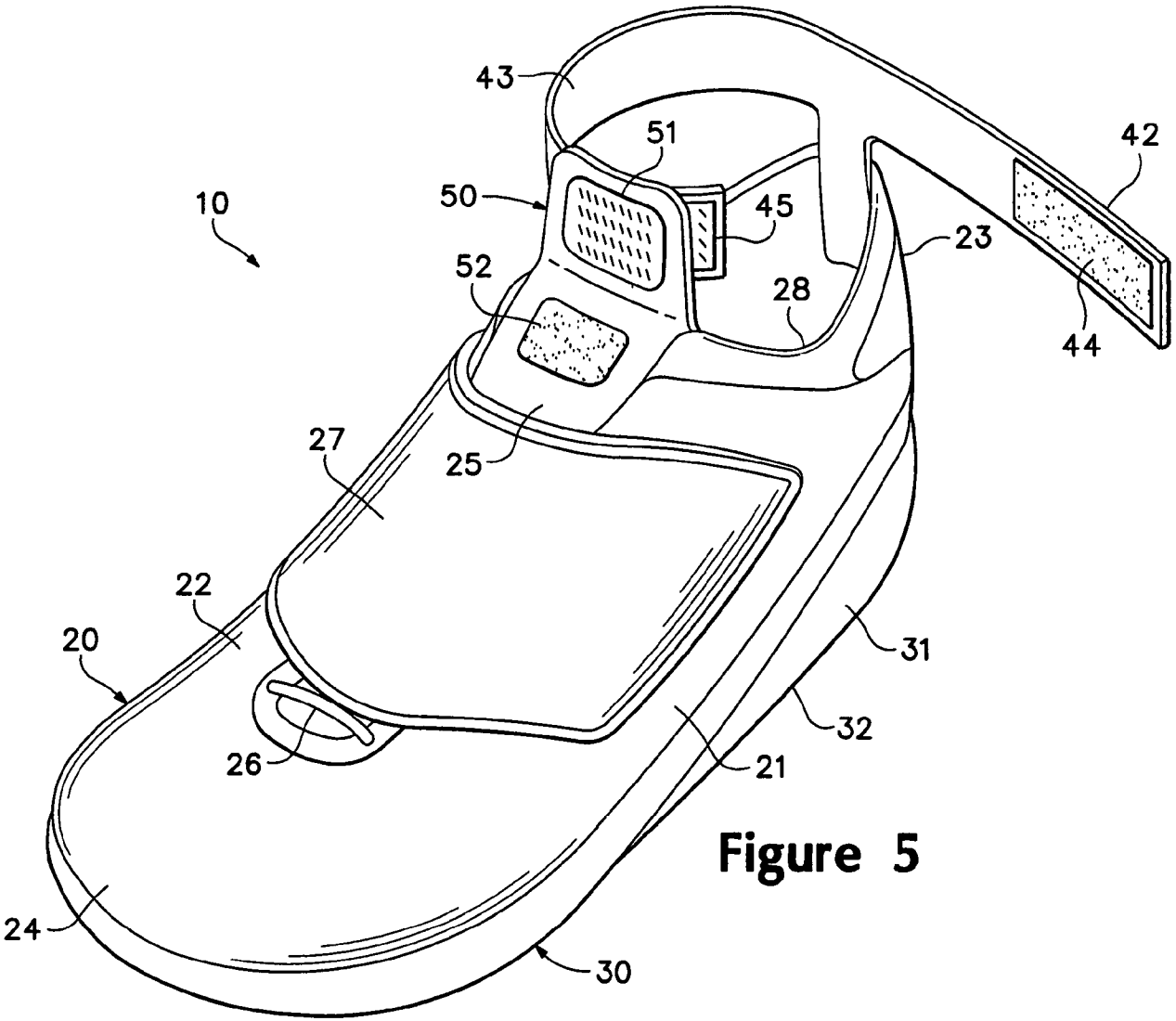
FIG. 5 is a perspective view of the first article of footwear in another intermediate state between the first configuration and the second configuration.

Placing article of footwear 10 in the second configuration is accomplished by opening ankle support 40 and extending tab 50 to the second position, as depicted in FIG. 4. This operation exposes part 51 of the two-part fastener associated with tab 50. Medial strap 43 is then wrapped around a medial side of the ankle and located behind tab 50, as depicted in FIG. 5. Lateral strap 42 is then wrapped around the lateral side of the ankle such that first part 44 contacts and joins with part 51. A portion of first part 44 may also join with second part 45 on either side of tab 50, thereby securing tab 50 to ankle support 40 and also securing lateral strap 42 to medial strap 43. In some embodiments of the invention, tab 50 may also include another part of the two-part fastener that joins with second part 45 and further secures tab 50 to ankle support 40. That is, both sides of tab 50 may include portions of the fastening system such that tab 50 is secured to both first part 44 and second part 45.

Based upon the above discussion, ankle support 40 has lateral strap 42 and medial strap 43 for extending around opposite sides of the ankle. First pat 44 and second part 45 of the fastening system are secured to each of straps 42 and 43, respectively, with parts 44 and 45 being joinable to secure the straps 42 and 43 around the ankle. Tab 50 is secured to tongue 25 and is convertible from a folded first position to an extended second position, and tab 50 has part 51 of the fastening system. Article of footwear 10 is convertible between the first configuration and the second configuration. In the first configuration, the tab is in the first position and separated from ankle support 40. In the second configuration, however, the tab is in the second position and located between the pair of straps 42 and 43 such that part 51 of the fastening system is joined with first part 44 of the fastening system to secure tab 50 to ankle support 40. Article of footwear 10 is also convertible to a third configuration, wherein ankle support 40 is detached from upper 20 and removed from article of footwear 10.

Figure 6:
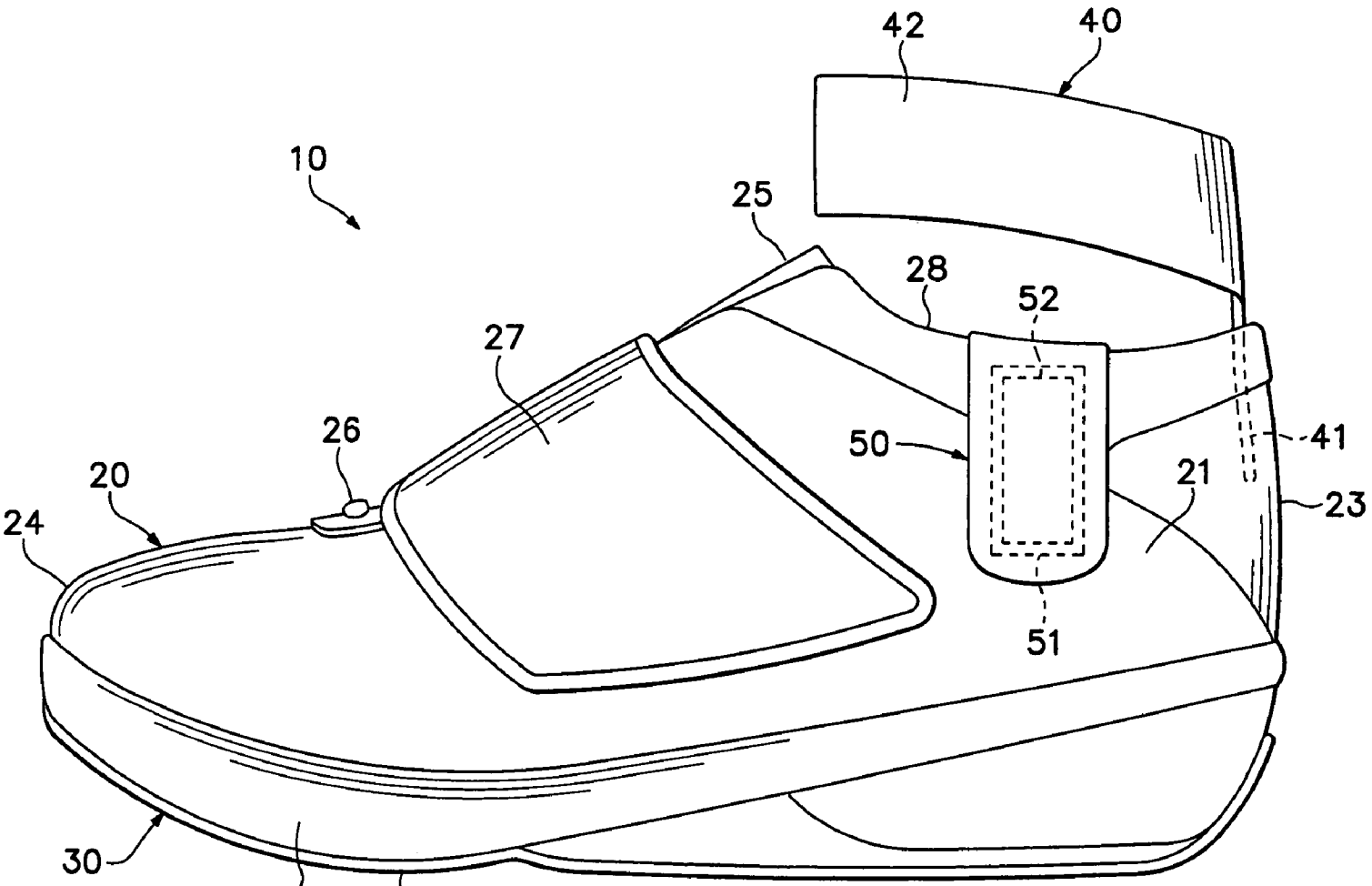
FIG. 6 is a side elevational view of a second article of footwear in accordance with the present invention, the second article of footwear being in a first configuration.
Figure 7:
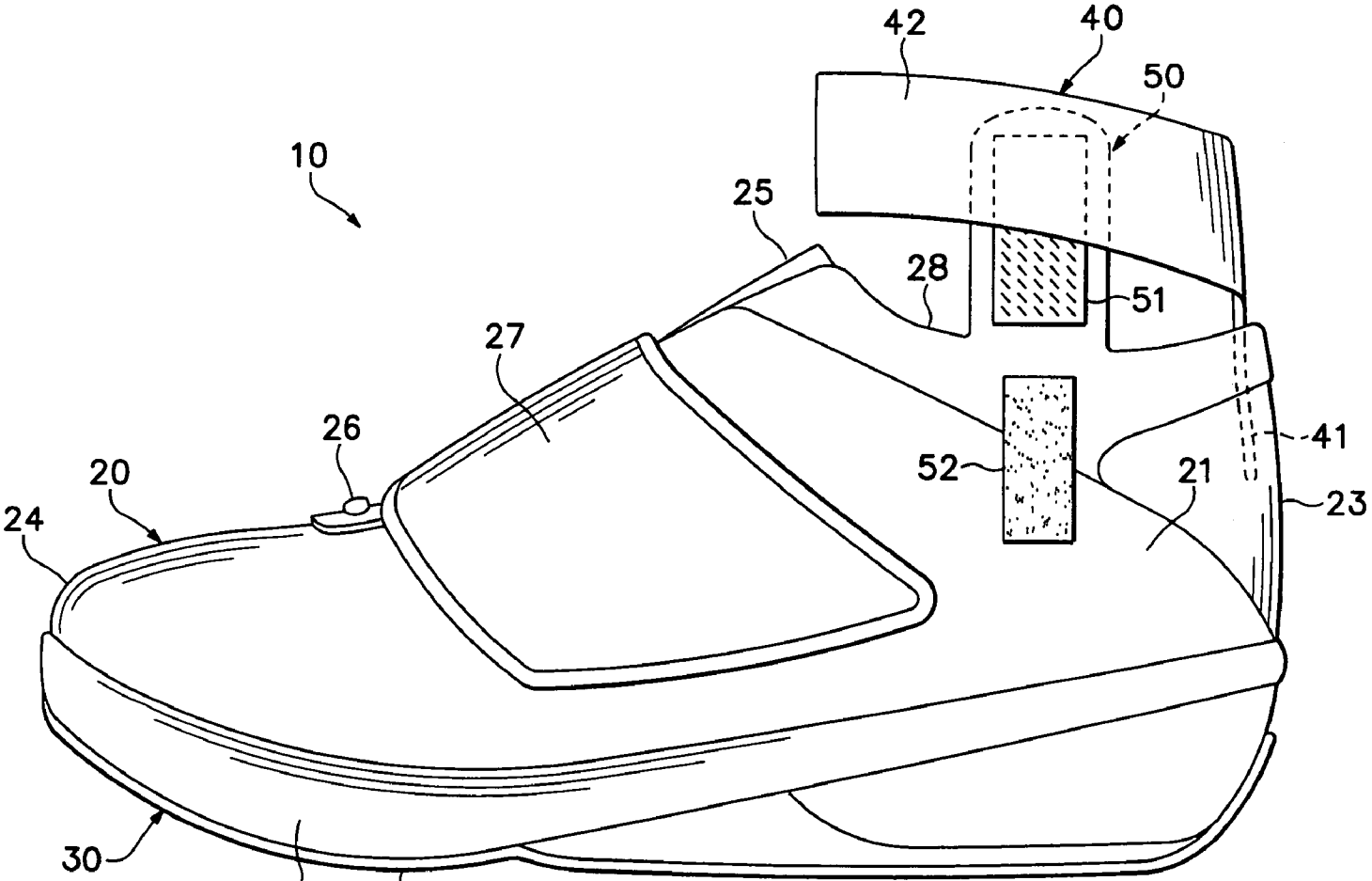
FIG. 7 is side elevational view of the second article of footwear in a second configuration.

In the above discussion, tab 50 is secured to tongue 25. In further embodiments, however, tab 50 may also be secured to other portions of upper 20. Referring to FIG. 6, tab 50 is positioned on lateral side 21 and a corresponding tab 50 may be secured to medial side 22. As depicted in FIG. 6, ankle support 40 imparts stability to article of footwear 10. As depicted in FIG. 7, however, tab 50 may be extended upward and joined with ankle support 40 to impart a greater degree of stability. Accordingly, one or more tabs 50 may be located in other portions of upper 20 in order to impart different degrees of stability to article of footwear 10.

In manufacturing article of footwear 10, the various elements of upper 20 are assembled around a last that imparts the general shape of a foot to the void within upper 20. That is, the various elements are assembled around the last to form lateral side 21, medial side 22, heel portion 23, and toe portion 24. In addition, the instep area is formed to include tongue 25, lace 26, and lace cover 27, for example, and ankle opening 28 is formed to provide the foot with access to the void within upper 20. A lasting sock may then be secured to a lower area of upper 20 so as to extend under the last and form a lower surface of the void within upper 20. A portion of sole structure 30 is then permanently secured to the lower area of upper 20, which includes the lasting sock. In joining upper 20 and sole structure 30, adhesives, stitching, or a combination of adhesives and stitching may be utilized. In this manner, upper 20 is secured to sole structure 30 through a substantially conventional process. Either before, during, or after the lasting process, ankle support 40 and tab 50 may be joined with upper 20.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear comprising an upper, an ankle support having a pair of ankle straps, and a sole structure, the article of footwear being convertible between:

a first configuration, wherein a tab associated with the upper is folded away from the ankle support, the footwear imparting a first degree of stability to an ankle when in the first configuration; and a second configuration, wherein the tab is extended to the ankle support and joined with the ankle support wherein the tab is positioned between the pair of ankle straps, the footwear imparting a second degree of stability to the ankle when in the second configuration.

2. The article of footwear recited in claim 1, wherein the tab is secured to a tongue portion of the upper.

3. The article of footwear recited in claim 1, wherein the tab is secured to at least one of a medial area and a lateral area of the upper.

4. The article of footwear recited in claim 1, wherein the ankle support includes a connecting member connected to the pair of ankle straps, the connecting member being secured to a rear area of the footwear, and the pair of ankle straps extending outward in opposite directions from an upper portion of the connecting member, the pair of ankle straps having a configuration that extends around opposite sides of the ankle and overlap when joined together.

5. The article of footwear recited in claim 4, wherein one of the pair of ankle straps includes a first part of a fastening system, another of the pair of straps includes a second part of the fastening system, and the tab includes a third part of the fastening system, the first part of the fastening system being joined with the second part of the fastening system when the pair of ankle straps extends around the ankle, and the tab extending between the pair of ankle straps such that the third part of the fastening system is joined with the first part of the fastening system when the footwear is in the second configuration.

6. The article of footwear recited in claim 5, wherein the fastening system is a hook and loop fastener.

7. The article of footwear recited in claim 1, wherein the first degree of stability is less than the second degree of stability.

8. The article of footwear recited in claim 1, wherein the ankle support is separable from the footwear to place the footwear in a third configuration, the footwear imparting a third degree of stability to the ankle when in the third configuration.

9. The article of footwear recited in claim 8, wherein the first degree of stability is less than the second degree of stability, and the third degree of stability is less than the first degree of stability.

10. An article of footwear comprising:

an ankle support with at least one ankle strap for extending around an ankle of the individual, the at least one ankle strap having a first part and a second part of a fastening system, the first part of the fastening system being joinable with the second part of the fastening system to secure the ankle support around the ankle;

an upper for receiving a foot of an individual, the upper including a tab that is convertible from a first position to a second position, the tab being folded downward in the first position, and the tab being extended upward in the second position, the tab having a third part of the fastening system; and a sole structure secured to the upper, the article of footwear being convertible between a first configuration and a second configuration, the tab being in the first position and separate from the ankle support in the first configuration, and the tab being in the second position such that the third part of the fastening system is joined with the first part of the fastening system in the second configuration.

11. The article of footwear recited in claim 10, wherein the tab is secured to a tongue portion of the upper.

12. The article of footwear recited in claim 10, wherein the ankle support is secured to a rear area of the upper.

13. The article of footwear recited in claim 10, wherein the fastening system is a hook and loop fastener.

14. The article of footwear recited in claim 10, wherein the tab extends between the first part and the second part of the fastening system when the footwear is in the second configuration.

15. The article of footwear recited in claim 10, wherein the ankle support is removable from the footwear to place the footwear in a third configuration.

16. The article of footwear recited in claim 10, wherein the tab is secured to at least one of a medial area and a lateral area of the upper.

17. An article of footwear comprising:

an ankle support having a pair of ankle straps for extending around opposite sides of an ankle of an individual, the pair of ankle straps each having one of a first part and a second part of a fastening system, the first part of the fastening system being join able with the second part of the fastening system to secure the pair of ankle straps around the ankle;

an upper for receiving a foot of an individual, the upper including a tab that is secured to a tongue portion of the upper and convertible from a first position to a second position, the tab being folded downward in the first position, and the tab being extended upward in the second position, the tab having a third part of the fastening system;

a sole structure secured to the upper, the article of footwear being convertible between:

a first configuration, wherein the tab is in the first position and separated from the ankle support; and a second configuration, wherein the tab is in the second position and located between the pair of ankle straps, the third part of the fastening system being joined with at least one of the first part of the fastening system and the second part of the fastening system to secure the tab to the ankle support.

18. The article of footwear recited in claim 17, wherein the ankle support is secured to a rear area of the upper.

19. The article of footwear recited in claim 17, wherein the fastening system is a hook and loop fastener.

20. The article of footwear recited in claim 17, wherein the ankle support is removable from the footwear to place the footwear in a third configuration.

21. A method of modifying an article of footwear, the method comprising steps of:

placing the footwear in a first configuration by wrapping a first strap and a second strap of an ankle support around opposite sides of the ankle, overlapping the first strap and the second strap, and joining the first strap to the second strap;

placing the footwear in a second configuration by positioning a tab between the first strap and the second strap, the tab being secured to an upper of the footwear, and joining a fastener on the tab with a corresponding fastener on one of the first strap and the second strap.

22. An article of footwear comprising:

an upper for receiving a foot of an individual, the upper including a tab that is convertible from a first position to a second position;

an ankle support for extending around an ankle of the individual, the ankle support being positioned proximal the tab; and a sole structure secured to the upper, the footwear being convertible between a first configuration and a second configuration, the tab being in the first position and separate from the ankle support in the first configuration, and the tab being in the second position and joined with the ankle support in the second configuration, and wherein the ankle strap includes a pair of ankle straps that extend around opposite sides of the ankle and overlap when joined together, and wherein one of the pair of ankle straps includes a first part of a fastening system, another of the pair of ankle straps includes a second part of the fastening system, and the tab includes a third part of the fastening system, the first part of the fastening system being joined with the second part of the fastening system when the pair of ankle straps extends around the ankle, and the tab extending between the pair of ankle straps such that the third part of the fastening system is joined with the first part of the fastening system when the footwear is in the second configuration.

* * * * *

UNITED STATES PATENT AND TRADEMARK OFFICE

CERTIFICATE OF CORRECTION

PATENT NO. : 7,334,354 B2
APPLICATION NO. : 10/860383
DATED : February 26, 2008
INVENTOR(S) : Thomas Foxen and Joshua P. Heard It is certified that error appears in the above-identified patent and that said Letters Patent is hereby corrected as shown below:

Claim 17, column 9, line 60, "join able" should be -- joinable --

Signed and Sealed this

Twenty-ninth Day of July, 2008

JON W. DUDAS
*Director of the United States Patent and Trademark Office*